US005747925A

United States Patent [19]

Kim

[11] Patent Number: 5,747,925

[45] Date of Patent: May 5, 1998

[54] ELECTRON GUN FOR CATHODE RAY TUBE

[75] Inventor: Hyeong-dong Kim, Suwon, Rep. of Korea

[73] Assignee: Samsung Display Devices Co., Ltd., Kyungki-do, Rep. of Korea

[21] Appl. No.: 570,985

[22] Filed: Dec. 12, 1995

[30] Foreign Application Priority Data

Dec. 28, 1994 [KR] Rep. of Korea ..... 94-38292

[51] Int. Cl.[6] ..... H01J 29/46; H01J 29/70

[52] U.S. Cl. ..... 313/446; 313/414; 313/421; 315/14

[58] Field of Search ..... 313/446, 425, 313/414, 421; 315/14

[56] References Cited

U.S. PATENT DOCUMENTS 5,180,945 1/1993 Kweon ..... 313/414

5,600,201 2/1997 Yun et al. ..... 313/414

FOREIGN PATENT DOCUMENTS 143760 11/1980 Japan ..... 313/425

*Primary Examiner*—Sandra L. O'Shea

*Assistant Examiner*—Joseph Williams

*Attorney, Agent, or Firm*—Leydig, Voit & Mayer, Ltd

[57] ABSTRACT

The triode portion of an electron gun includes a cathode having an electron emitting material layer and a control electrode in which a through hole portion having a plurality of through holes for passing an electron beam is formed on a surface facing the electron emitting material layer so that the life span of the cathode can be prolonged.

5 Claims, 5 Drawing Sheets

ELECTRON GUN FOR CATHODE RAY TUBE

BACKGROUND OF THE INVENTION

The present invention relates to an electron gun for a cathode ray tube, and more particularly, to an electron gun for a color cathode ray tube provided with an improved control electrode forming a triode portion.

Generally, as shown in FIG. 1, a cathode ray tube is basically composed of a panel 4 from which a shadow mask frame assembly 3 is spaced at a predetermined distance from a fluorescent film 2 formed on the inner surface of the panel, a funnel 5 sealingly attached to panel 4, and a neck potion of funnel 5 housing an electron gun 6 and having a deflection yoke 7 installed outside of the housing 5.

In the cathode ray tube constructed as above, an electron beam emitted from electron gun 6 is selectively deflected by deflection yoke 7, depending on the scanning position of fluorescent film 2 to thereby be landed on fluorescent film 2 resulting in forming a picture. In such a cathode ray tube, an emission capability for emitting a thermal electron from electron gun 6 plays a critical role in the life span of the cathode ray tube. Accordingly, in order to prolong the life span of the cathode ray tube, a cathode exhibiting constant-intensity emission characteristics should be employed.

FIG. 2 shows an example of such an electron gun for the color cathode ray tube.

The electron gun includes a triode portion 20, i.e., a source of generating electron beam, a focus electrode 30 installed sequentially from triode portion 20 and having through holes to thereby form an auxiliary lens portion and a final acceleration electrode 40 which, together with focus electrode 30, forms a main lens portion.

In the electron gun constructed as above, a predetermined voltage is supplied to triode portion 20 and each electrode so that the electron beam emitted from triode portion 20 passes through an electron lens formed between the electrodes, which is not shown in the drawings. After being converged and accelerated by the electron gun, the electron beam passing through the electron lens is landed on a fluorescent surface to excite a fluorescent body and thus the picture is formed. The performance of the electron gun depends on the state (namely, the state of a current density, the degree of halo effect and a diverging angle) of the electron beam emitted from the triode portion, i.e., the source of generating the electron beam. Accordingly, triode portion 20 is the most important part in the electron gun.

As shown in FIG. 3, a conventional triode portion 20 of such an electron gun includes a cathode 25 having a base metal 23 coupled to the end of a sleeve 22 incorporating a heater 21. The surface of the base metal 23 may be doped with an electron emitting material. A control electrode 26 and a screen electrode 27 are each installed to be spaced from cathode 25 at a predetermined distance and include through holes 26H and 27H for the electron beam in a region aligned with in line with base metal 23.

In triode portion 20 constructed as above, with the emission of heat by supplying a predetermined voltage to heater 21 of cathode 25, electron emitting material 24 is heated to thereby emit the thermal electron. The thermal electron is preliminarily converged and accelerated by a cathode lens (not shown) formed by a through hole 26H for the electron beam formed in a control electrode 26 and a through hole 27H for the electron beam formed in a screen electrode 27.

However, through hole 26H for electron beam of control electrode 26 installed in front of cathode 25 forming the triode portion is formed to be one hole. Therefore, the electric field forming the cathode lens or that for forming main lens with final acceleration electrode 40 receiving a high voltage is induced so as to extend to through hole 26H for the electron beam. Accordingly, the strongest electric field is formed on the central portion of cathode 25, namely, the central portion of electron emitting material layer 24, to concentrically emit the thermal electrons from the central portion of electron emitting material layer 24 to thereby be a main cause of the life span reduction of cathode 25. Also, it is difficult to control the electron beam due to the speed difference of the thermal electron between the central and outer portions of electron emitting material layer 24.

To solve such a problem, in the past, the central portion of the thermal electron emitting material layer doped on the base metal is concavely recessed by concavely forming the surface of the base metal of the cathode to thereby reduce the effect of the permeated electric field. However, such a cathode cannot completely exclude the influence of the electric field permeated from the through hole for the electron beam formed in the control electrode.

SUMMARY OF THE INVENTION

It is an object of the present invention to provide an electron gun for a cathode ray tube for preventing the convergence of an electric field extending to a through hole for an electron beam of a control electrode to the central portion of a cathode to prolong the life span of the cathode and control an electron beam easily.

To accomplish the above object, there is provided an electron gun for a cathode ray tube including a triode provided with a cathode in which an electron emitting material layer is formed and a control electrode in which a plurality of through holes for an electron beam are formed on a surface facing the electron emitting material layer of the cathode.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
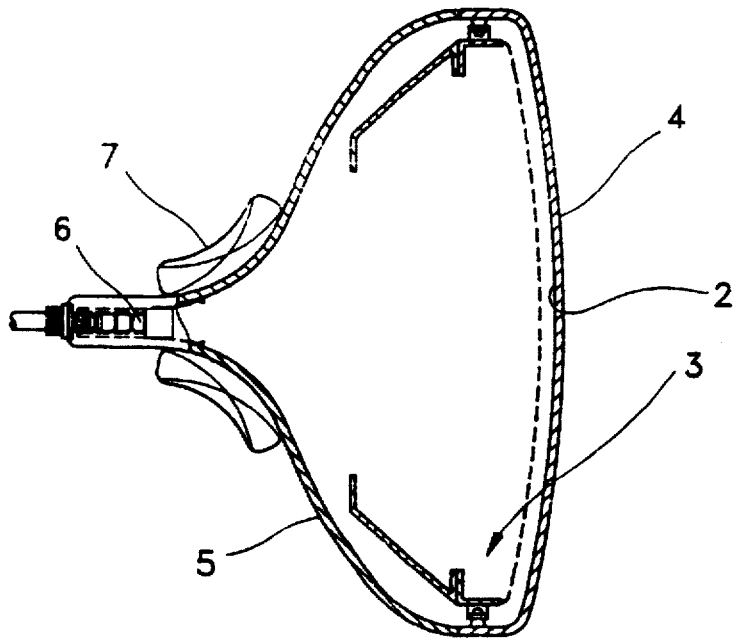
FIG. 1 is a cross sectional view of a general cathode ray tube.
Figure 2:
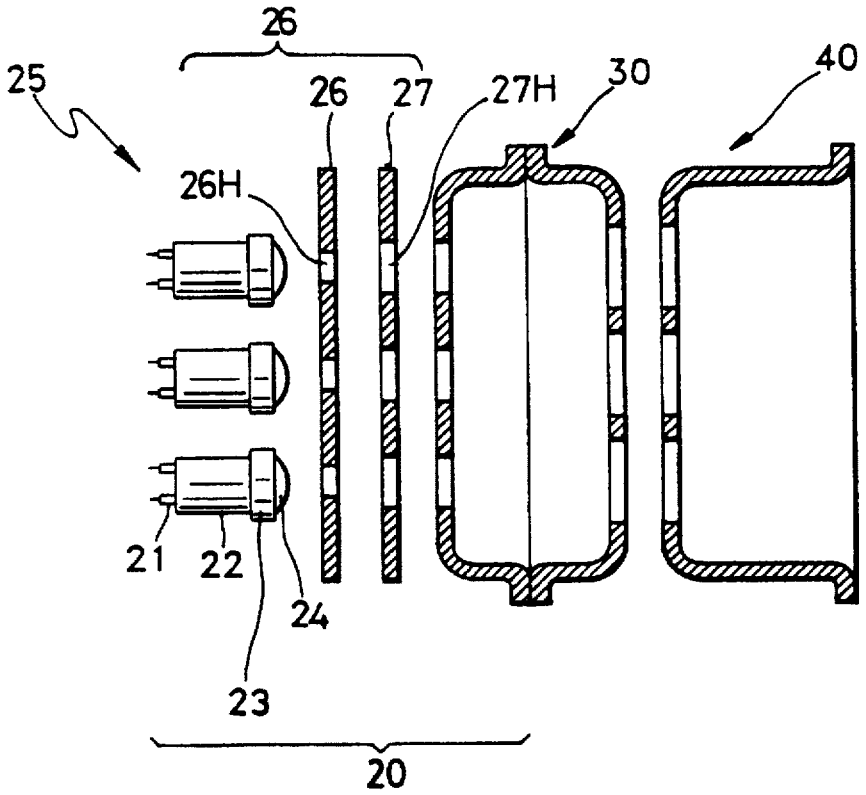
FIG.2(PRIOR ART)
FIG. 2 is an exploded cross sectional view for illustrating one example of a conventional electron gun for the cathode ray tube.
Figure 3:
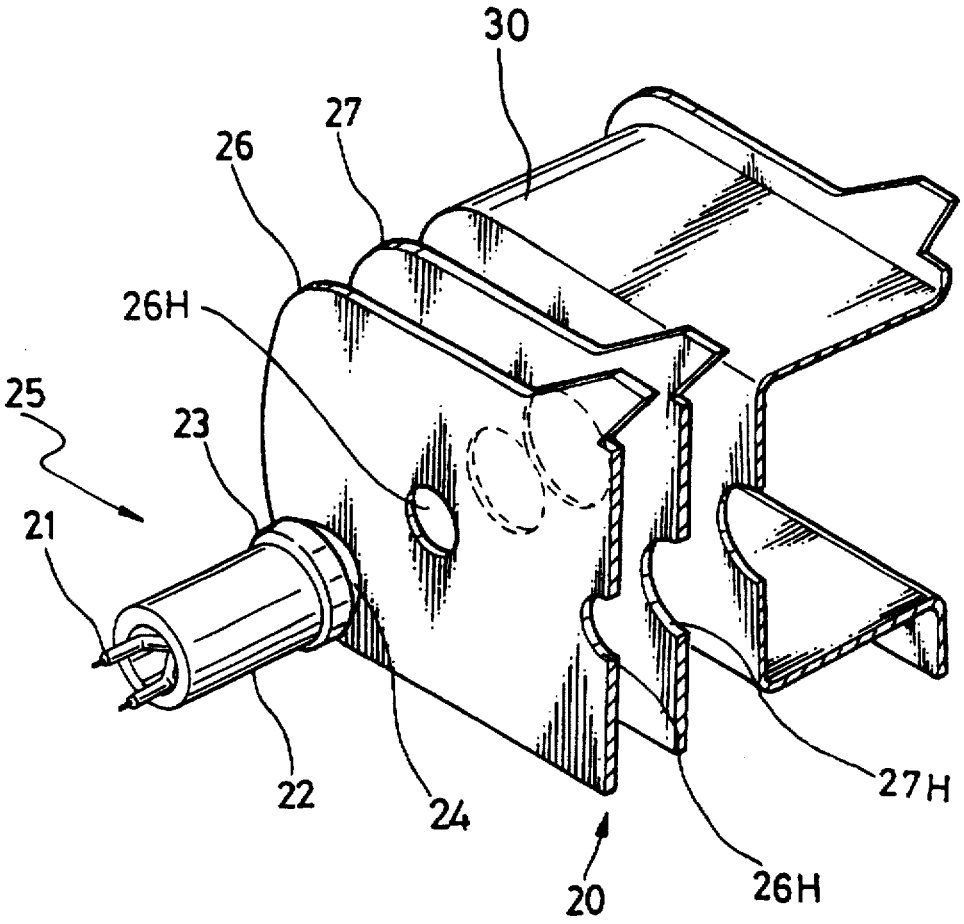
FIG.3(PRIOR ART)
FIG. 3 is an exploded perspective view for illustrating a triode portion shown in FIG. 2.
Figure 4:
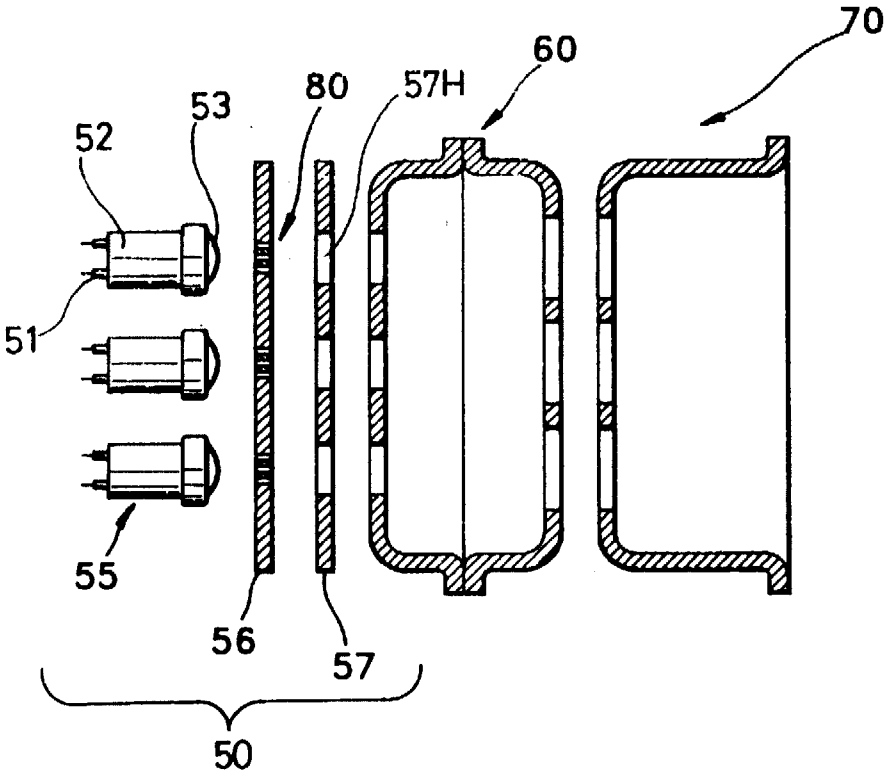
FIG. 4 is an exploded cross sectional view of an electron gun for a cathode ray tube according to the present invention.

An electron gun according to the present invention is mounted to the neck portion of a cathode ray tube to emit a thermal electron and one embodiment is shown in FIG. 4.

Figure 5:
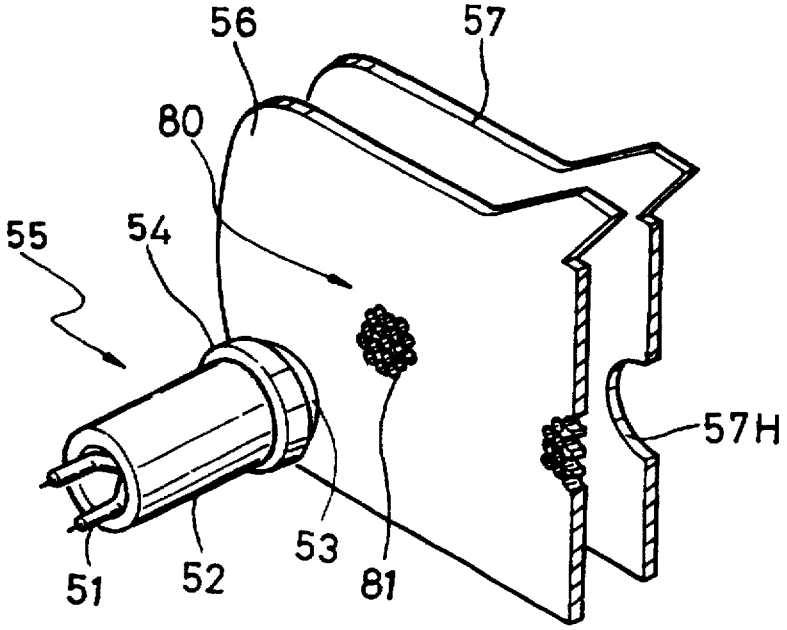
FIG. 5 is a perspective view for illustrating a triode portion of the electron gun according to the present invention.

The electron gun includes a triode portion 50, i.e., a source of generating an electron beam, a focus electrode 60 which is installed coaxially with triode portion 50 and to which a predetermined voltage is supplied and a final acceleration electrode 70. Here, triode portion 50 generates an electron beam and controls the generation of the electron beam. As shown in FIG. 5, triode portion 50 includes a cathode 55 and a control electrode 56 and a screen electrode 57 which are installed sequentially from cathode 55 and in which a through hole portion 80 for the electron beam and a through hole 57H for the electron beam are formed.

Cathode 55 includes a heater 51, a sleeve 52 incorporating heater 51 and a base metal 54 installed to the end of sleeve 52 and having a electron emitting material layer 53 on the upper surface thereof.

Through hole portion 80 for the electron beam formed on a control electrode 56 of a portion facing electron emitting material layer 53 has a plurality of uniformly distributed small through holes 81 for the electron beam. Small through holes 81 for the electron beam may be formed to have varied diameters and the distribution thereof can be varied as well.

Figure 6:
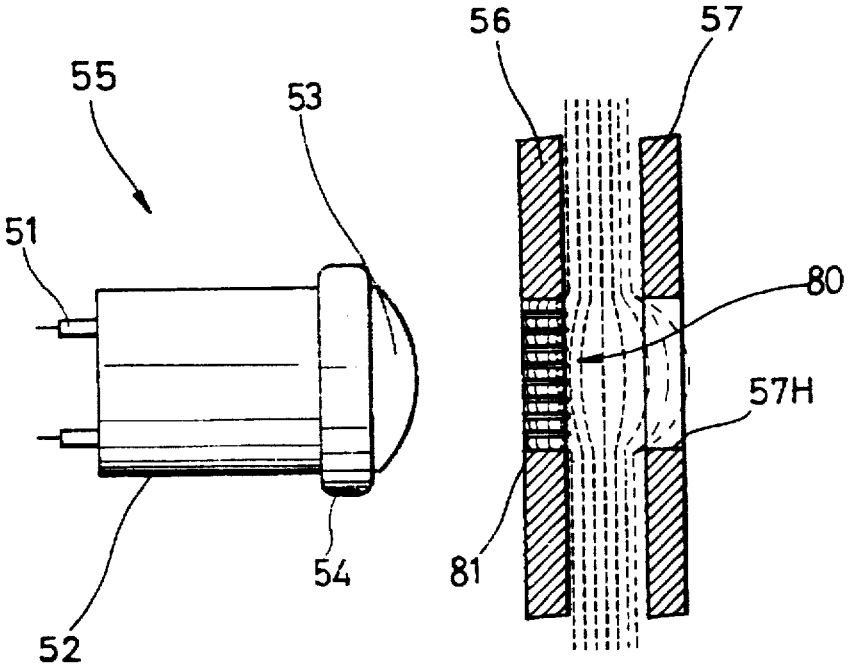
FIG. 6 is a cross sectional view for illustrating a visualized state that an electric field extends to an electron beam passing portion of a control electrode shown in FIG. 4.

In the electron gun for the cathode ray tube according to the present invention constructed as above, a predetermined voltage is supplied to heater 51 of cathode 55 forming triode portion 50 so that heater 51 emits a heat to thereby heat electron emitting material layer 53. Along with the heating of electron emitting material layer 53, the thermal electrons emitted from electron emitting material layer 53 pass through each through hole 81 for the electron beam of through hole portion 80 for the electron beam formed in control electrode 56. Since through hole portion 80 for the electron beam has a plurality of small through holes 81 for the electron beam, it is possible to prevent the extension of the electric field of the cathode lens formed between control electrode 56 and screen electrode 57 and the extension of the electric field of final acceleration electrode 70 and focus electrode 60 forming a main lens from focusing on a specific portion, namely, in the central portion of electron emitting material layer 53, as shown in FIG. 6. Accordingly, it is possible to make the speed of the thermal electron emitted from the central portion of electron emitting material layer 53 and a neighboring portion thereof uniform to thereby control the electron beam easily. Also, since the emission of the electron beam as in the conventional method can be prevented from focusing on the central portion, it is possible to prevent electron emitting material layer 53 located in the central portion from deteriorating in a comparatively short time and thus the life span according to the electron emission of electron emitting material layer 53 can be prolonged.

As described above, the electron gun for the cathode ray tube of the present invention having a plurality of through holes for the electron beam forming the through hole portion for the electron beam formed in the control electrode of the triode portion can be widely used not only in black-and-white and color cathode ray tubes, but also in a picture display apparatus used in test equipment. The present invention is not limited to the above embodiment and many alteration can be made by those of ordinary skill of the art within the scope of the technical ideas of the present invention written in the attached claims.

What is claimed is:

1. A triode for an electron gun for a cathode ray tube comprising:

a cathode having an electron emitting material layer, a control electrode, and a screen electrode, the control electrode including a plurality of through hole regions for an electron beam, each through hole region having a plurality of through holes facing the electron emitting material layer of the cathode, the screen electrode having a plurality of through holes corresponding to the plurality of through hole regions, respectively.

2. A triode according to claim 1, wherein the plurality of through holes for the electron beam are uniformly distributed in each through hole region.

3. A triode according to claim 1, wherein the screen electrode includes a plurality of through holes each through hole corresponding to a respective through hole region in said control electrode and wherein a diameter of each of the through holes in the plurality of through hole regions is smaller than a diameter of the plurality of through holes in said screen electrode.

4. A triode for an electron gun comprising:

a cathode having an electron emitting material layer;

a control electrode including a through hole region facing the electron emitting layer of said cathode, the through hole region including a plurality of through holes; and a screen electrode including through holes facing the through hole region of said control electrode.

5. A triode according to claim 4 wherein each through hole in the through hole region includes a diameter smaller than a diameter of the through holes of said screen electrode.

* * * * *